US008939325B2

(12) United States Patent
Liang et al.

(10) Patent No.: US 8,939,325 B2
(45) Date of Patent: Jan. 27, 2015

(54) DISPENSER FOR A FOAMING LIQUID COMPOSITION WITH IMPROVED FOAM RECOVERY FEATURE

(75) Inventors: ZhiHao Liang, Dongguan (CN); XianZhi Zhou, Dongguan (CN)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 50 days.

(21) Appl. No.: 13/990,486

(22) PCT Filed: Nov. 7, 2011

(86) PCT No.: PCT/GB2011/052150

§ 371 (c)(1), (2), (4) Date: Jun. 21, 2013

(87) PCT Pub. No.: WO2012/076860

PCT Pub. Date: Jun. 14, 2012

(65) Prior Publication Data

US 2014/0076924 A1 Mar. 20, 2014

(30) Foreign Application Priority Data

Dec. 9, 2010 (GB) ..... 1020841.1

(51) Int. Cl.
*B67D 7/76* (2010.01)
*A47K 5/16* (2006.01)
(Continued)

(52) U.S. Cl.
CPC ..... *A47K 5/16* (2013.01); *B05B 7/0025* (2013.01); *B05B 15/0275* (2013.01); *A47K 5/1217* (2013.01)
USPC ..... 222/190; 222/63; 222/325

(58) Field of Classification Search
CPC ..... A47K 5/1217; A47K 5/16; A47K 5/1211; A47K 5/14; B05B 7/0025; B05B 15/0275; B05B 7/0018; B05B 7/2489; B05B 7/2491
USPC ..... 222/109, 110, 190, 52, 63, 333, 318, 222/424, 325, 184, 185.1, 255, 478, 479, 222/481, 481.5, 482, 484, 135–137; 239/119, 125, 127; 169/14, 15
See application file for complete search history.

(56) References Cited

U.S. PATENT DOCUMENTS 5,398,845 A * 3/1995 Meyer ..... 222/1
5,439,140 A * 8/1995 Meyer ..... 222/110
(Continued)

FOREIGN PATENT DOCUMENTS

EP 1604600 A2 12/2005
JP 2000070774 A 3/2000
(Continued)

OTHER PUBLICATIONS

International Search Report and Written Opinion mailed Jun. 25, 2012 for priority application PCT/GB2011/052150.
(Continued)

*Primary Examiner* — Patrick M Buechner
(74) *Attorney, Agent, or Firm* — Troutman Sanders LLP; Ryan A. Schneider; Troy S. Kleckley

(57) ABSTRACT

A foaming pump mechanism for dispensing a foamable or foaming liquid composition, as well as dispensers for delivery of a foaming or foamable liquid composition therefrom which is operable by a non-contact interaction with the user. The foaming pump mechanism includes foam recovery.

17 Claims, 8 Drawing Sheets

(51) Int. Cl.

| | |
|---|---|
| ***B05B 7/00*** | (2006.01) |
| ***B05B 15/02*** | (2006.01) |
| ***A47K 5/12*** | (2006.01) |

(56) References Cited

U.S. PATENT DOCUMENTS

| | | | | |
|---|---|---|---|---|
| 5,458,289 | A | 10/1995 | Cater | |
| 5,544,788 | A * | 8/1996 | Meyer | 222/110 |
| 5,779,104 | A | 7/1998 | Reidel | |
| 2003/0000967 | A1 | 1/2003 | Ehrensperger | |
| 2005/0258192 | A1 * | 11/2005 | Matthews et al. | 222/190 |
| 2007/0023454 | A1 | 2/2007 | Ophardt | |
| 2007/0051748 | A1 | 3/2007 | Yates | |
| 2011/0017769 | A1 * | 1/2011 | Ophardt | 222/1 |
| 2013/0032614 | A1 * | 2/2013 | Babikian et al. | 222/190 |

FOREIGN PATENT DOCUMENTS

| | | | |
|---|---|---|---|
| WO | 2009037417 | A1 | 3/2009 |
| WO | 2010055309 | A1 | 5/2010 |
| WO | 2010055313 | A1 | 5/2010 |
| WO | 2010055314 | A1 | 5/2010 |
| WO | 2011004184 | A1 | 1/2011 |

OTHER PUBLICATIONS

Combined Search and Examination Report Under Sections 17 and 18(3) mailed Mar. 17, 2011 for priority British Patent Application GB1020841.

* cited by examiner

DISPENSER FOR A FOAMING LIQUID COMPOSITION WITH IMPROVED FOAM RECOVERY FEATURE

CROSS-REFERENCE TO RELATED APPLICATIONS

This application is a US National Stage of International Application No. PCT/GB2011/052150, filed 7 Nov. 2011, which claims the benefit of GB 1020841.1, filed 9 Dec. 2010, both herein fully incorporated by reference.

The present invention relates to a dispenser for a foaming liquid composition. More particularly the present invention relates to a dispenser for delivery of a foaming liquid composition from a refill unit containing a quantity of the foaming liquid composition which is fitted into said dispenser, although the principles of the present invention may be used in dispensers which contain a foaming liquid composition in a receptacle or reservoir other than a refill unit.

From a consumer perspective, dispensers which automatically provide a metered dose of a foaming liquid composition are highly desirable. Delivery of a foamed liquid composition, e.g., a soap, a cleaning composition, a topical treatment composition, a foamed or foamable composition for application to the epidermis, hair or other part of a human or animal body is advantageous in several respects. The foam structure of the foamed liquid composition provides for a mass of the liquid composition with an expanded volume due to the air or other gas entrained within the foamed liquid composition which provides a perception of a greater mass of product being delivered, and at the same time the foamed liquid composition is frequently easier to deliver to a surface e.g., a hard surface, an epidermis, etc. Furthermore the use of a foamed liquid composition often accelerates the spreading and distribution of the foamed liquid composition onto a surface.

Currently dispensers which provide a metered dose of a foaming liquid composition are often manually operated pump-type dispensers which requires that a user must necessarily compress a part of the pump, in order to deliver a dose of foamed liquid composition. Such requires physical contact between the user and the dispenser, which is not always desirable. Many common maladies, e.g., influenza virus, rhinovirus, may be undesirably transmitted between users of such a manually operated pump-type dispenser which increases the incidence and spread of diseases. Furthermore, manually operated pump-type dispensers also frequently become unattractive in appearance due to repeated physical contact between the user and the dispenser which user while utilizing the dispensed foamed liquid composition provided, rarely or consistently also cleans the pump.

Known to the art are automatic dispensers for the delivery of liquids from a reservoir contained within the said dispenser device, which may be a reservoir for storing liquids prior to their delivery, particularly for dispensing liquid soaps in response to a non-contact interaction with the user, e.g. the use of one or more sensors to determine the proximity of a user. Such "hands free" dispensing device, and refill units useful therewith are generally known to the art, and include those commonly assigned to the proprietor of the instant patent application. Such include the dispenser and refill unit disclosed in PCT/GB2009/002682; a relief valve and a cap assembly as disclosed in PCT/GB2009/002672, as well as the bottle with a tamper proof-cap as disclosed in PCT/GB2009/002678. The entire contents of these patent applications are herein incorporated by reference thereto. While the dispenser and refill unit described in WO 2010/055314 provides certain advantages over other prior art dispensers and while it may be very advantageously used for the delivery of a liquid compositions it is poorly suited for reliably dispensing foaming liquid compositions in the manner provided by the present application, particularly metered doses of a foamed liquid composition.

Thus there is a real and urgent need for further improvements to dispensers for the delivery of a foaming or foamable liquid composition therefrom.

In one aspect the present invention provides a foaming pump mechanism for dispensing a foamable or foaming liquid composition, which provides an improved foam recovery means.

In a second aspect of the invention there is provided a dispenser for a foaming or foamable liquid composition therefrom which is operable by a non-contact interaction with the user.

In a third aspect the present invention provides a dispenser for a foaming or foamable liquid composition therefrom which delivers the said liquid composition from a user replaceable refill, and which further includes a means for recovery of dispensed foaming or foamable liquid composition.

In a fourth aspect the present invention provides a dispenser for a foaming or foamable liquid composition therefrom which delivers the said liquid composition from a vessel, container or reservoir which forms a part of the said dispenser, and which further includes a means for recovery of dispensed foaming or foamable liquid composition.

In a yet further aspect the present invention provides a method for dispensing a foaming or foamable liquid composition to a user which dispensing is initiated by a non-contact interaction with the user, which method includes recovery of dispensed foaming or foamable liquid composition.

In a still further aspect of the invention there is provided a method for dispensing a foaming or foamable liquid composition to a user, which includes improved foam recovery of foaming or foamable liquid composition within a dispense cycle.

Further features and aspects of the invention will be understood from a reading of the following specification, and in view of the accompanying drawing figures. In the drawing figures, like elements present are indicated using the same reference numeral for consistency throughout the drawing figures.

The dispensing device may be one which is manually powered, e.g., a pump-type dispenser whereby a quantity of foamable liquid composition is dispensed by manually operating the foaming pump mechanism. In a preferred aspect the present invention provides a dispenser which comprises a base with a delivery mechanism for dispensing a foamable liquid composition (liquid product) therefrom which base also includes an actuator means. The actuator means is preferably a mechanism which does not require physical contact between a user of the dispenser in order to initiate delivery of a quantity of a foamed liquid composition to the user. The actuator means actuation mechanism advantageously includes one or more sensors which are responsive to the proximity of a user to the dispenser device which triggers the actuator means to deliver the quantity of a the foamable liquid composition through the foaming pump mechanism to the user. The dispensing device may also be a device which includes a motor driven pump, such as disclosed in PCT/GB2009/002682 the contents of which are herein incorporated by reference thereto, but in which the foaming pump mechanism is installed or included.

Figure 1:
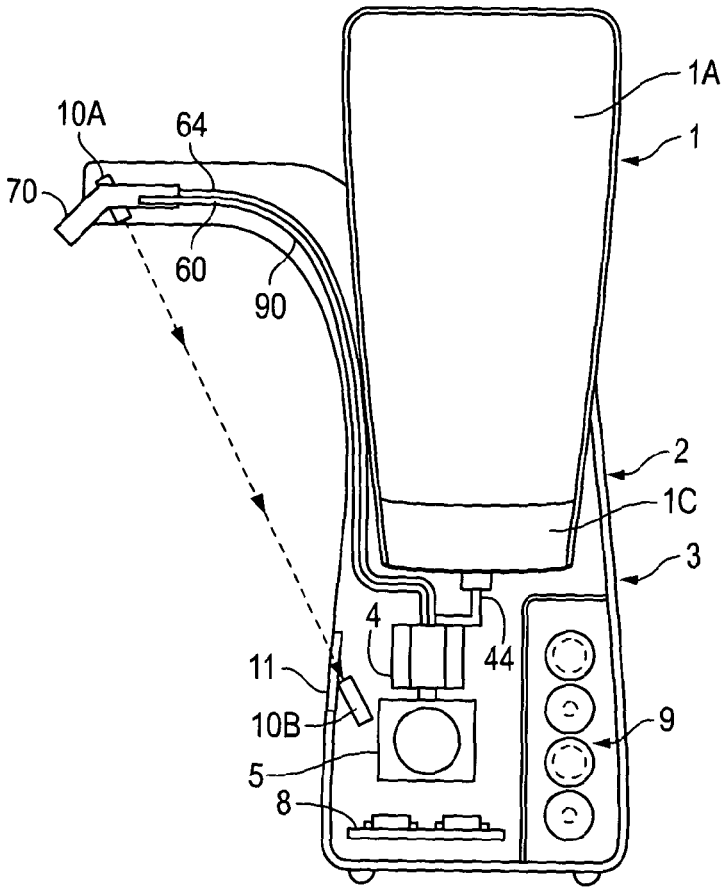
FIG. 1 illustrates a cross-sectional view of a hands-free dispensing device, and a refill unit mounted therein wherein the device includes a foaming pump mechanism as will be described in more clearly with reference to the following figures.

FIG. 1 illustrates a hands-free dispenser which is generally suitable for domestic use which includes the combination of a refill unit 1 with a base 2. The refill unit 1 provides a supply or a supply reservoir of a foaming or foamable liquid product (liquid composition) to be dispensed via the base 2. The refill unit 1 is removably insertable into the base 2 such that when exhausted, a fresh supply may be provided to the said dispenser. The base 2 has an interface 3 which is in fluid communication with a foaming pump mechanism 4 driven by a motor 5, which is in turn in fluid communication with a dispensing nozzle 70 via an intermediate liquid outlet tube 60 and an intermediate air outlet tube 64. A further foam recovery tube 90 connected to the dispensing nozzle 70 and the foaming pump mechanism 4 is also depicted. The foaming pump mechanism 4 is selectively operable to pump a metered dose of the foamable liquid composition in response to a suitable control or trigger signal. The base 2 further includes suitable controller logic circuitry 8 herein depicted as a printed circuit board having one or more solid-state components included thereon which operates as a controller means for the base 2, a power source, here depicted as an array of batteries 9, here four "AA" nominal 1.5 DC voltage batteries, and an infrared transmitter 10A which transmits an infrared beam through a window 11 to an infrared receiver 10B noted to sense the presence of a user's hands in the vicinity of the base 2. The controller logic circuitry 8 is responsive to the signal from the infrared beam transmitter 10A and infrared receiver 10B to activate the foaming pump mechanism 4. In the depicted embodiment, the illustrated infrared beam transmitter 10A and infrared receiver 10B are of the "break beam" type, however any known proximity sensor can be used. One such proximity sensor is a capacitance sensor, but others known to the art can be used in place of the beam transmitter 10A and infrared receiver 10B. Alternately a mechanical switch or other actuation means which requires physical contact with a user in order to activate the foaming pump mechanism 4 in order to dispense a quantity of liquid may be used in place of the proximity sensor wherein a hands-free mode of operation is unnecessary or not desired.

In FIG. 1, although an array of batteries 9 is illustrated, the base 2 can be powered by any suitable power source, including but not limited to direct connection to a power supply, to wall mains power, or via an intermediate voltage step down transformer or other power supply intermediate the base 2 and the wall mains power. The base 2 may also be supplied with rechargeable batteries. The operation of rechargeable batteries may be supplemented by, or the batteries may be charged by, a photovoltaic panel responsive to light and which generates a current.

Figure 2A:
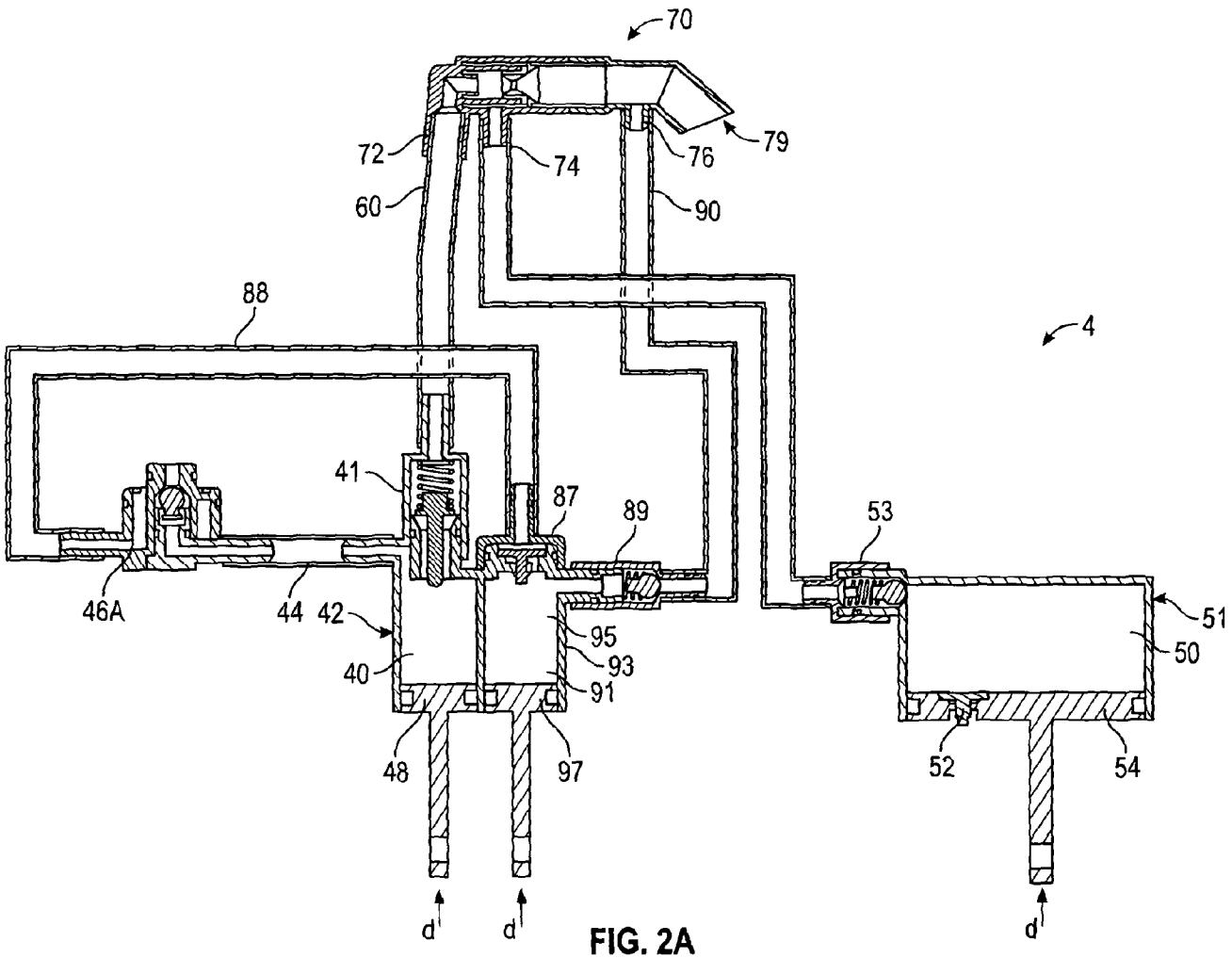
FIGS. 2A, 2B, 2C and 2D illustrate in cross-sectional views a preferred embodiment of a foaming pump mechanism which includes a means for recovery of dispensed foaming or foamable liquid composition in four different and sequential states of operation.
Figure 2B:
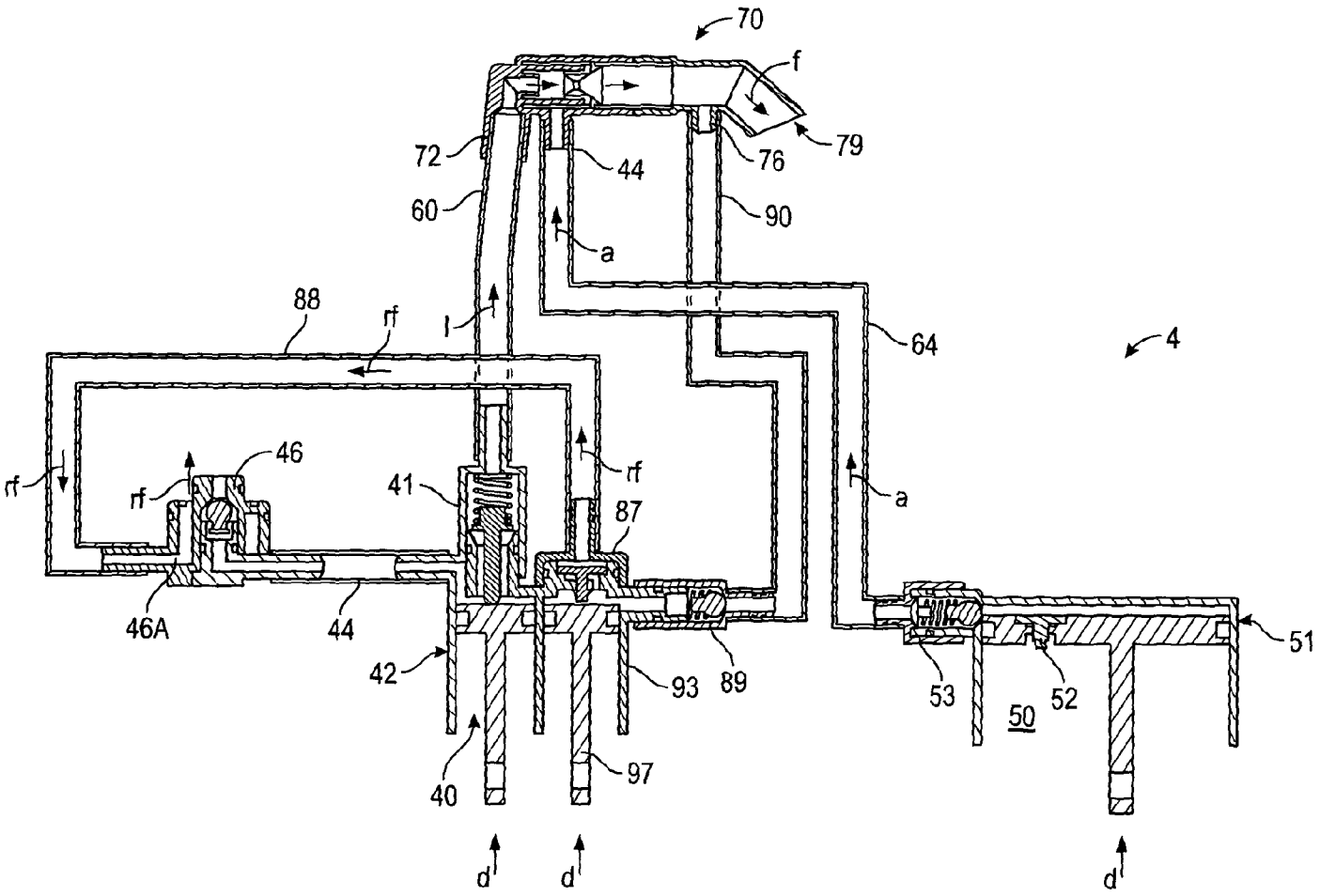

FIG. 2A illustrates in a representational cross-sectional view a first state of the foaming pump mechanism 4 according to a preferred embodiment of the invention. As depicted thereon, the bore 40 of the liquid cylinder 42 is in fluid communication via a supply tube 44 and a supply valve 46 with a supply of a foamable liquid composition (not shown) which said supply may be, a reservoir or a refill bottle, e.g., refill unit 1, containing a quantity of the foamable liquid composition. In this first state, the bore 40 is filled with the foamable liquid composition, and the liquid cylinder piston 48 is at the base (bottom) of its stroke cycle, coinciding with the largest volume of the bore 40. Concurrently the bore 50 of the air cylinder 51 is filled with air which has entered the bore 50 via an air supply valve 52 present within the air cylinder piston 54, which is also at the base of its stroke cycle, coinciding with the largest volume of bore 50. Also visible in the figure and downstream of the bore 40 of the liquid cylinder 42 is a liquid outlet valve 41, as is more clearly illustrated in FIGS. 3A and 3B. As described in more detail in FIGS. 3C and 3D, The liquid outlet valve 41 comprises a valve bore 41A, a biasing spring 41B, a bore shoulder 41C, a valve seat 41D and a valve 41E mounted upon a valve shaft 43, and preferably as shown, the valve shaft 43 has a proximal end 43A extending at least to but preferably past the valve seat 41D and into the bore 40. The biasing spring 41B extends within the valve bore 41A. In the position or state shown in FIG. 3C, the valve 41E is engaged against the valve seat 41D which closes the liquid outlet valve 41 denying passage of the foamable liquid composition therethrough. The liquid outlet valve 41 is connected to a liquid outlet tube 60 which itself extends to and is in fluid communication with a dispensing nozzle 70 via a liquid inlet port 72. Referring to FIGS. 2A and 2B, downstream of the bore 50 of the air cylinder 51 is an air outlet 53 valve, an air outlet tube 64 which itself extends and is in fluid communication with the dispensing nozzle via an air inlet port 74. The foaming pump mechanism 4 further includes an improved foam recovery means, here a foam recovery cylinder 93 having a foam bore 95 and foam recovery piston 97. The foam bore 95 is in fluid communication with the foam recovery tube 90 via a foam check valve 89 and the foam bore 95 is also in fluid communication with the supply valve 46 and the supply of a foamable liquid composition (not shown, e.g., refill unit 1) via a foam recycle valve 87 which is connected to the supply valve 46 via a foam recycle tube 88. In the first state of the foaming pump mechanism, the maximum volume of the bore 40, of bore 50 is established by the relative positions of the piston, bore 40 contains the foamable liquid composition, bore 50 contains air and the foam bore 95 contains recovered foam which had entered the foam bore 95 from the foam recovery tube 90 via the foam check valve 89. Further the supply valve 46 and the foam recycle valve 87 are each in an open state or open position, while the liquid outlet valve 41, the air outlet valve 53, the foam check valve 89, the supply valve 46 and the air supply valve 52 are in a closed state or in a closed position.

In FIGS. 2A-2D, the direction of travel of liquid within the foaming pump mechanism 4 is illustrated by directional arrows labeled "l", the directional travel of air foaming pump mechanism 4 is illustrated by directional arrows labeled "a", the direction of motion of the pistons 48, 54 is illustrated by directional arrows labeled "d", the direction of travel of foamed liquid composition within the foaming pump mechanism 4 is illustrated by directional arrows labeled "f", the direction of travel of foam and/or liquid composition is illustrated by directional arrows labeled "f/l", and the direction of travel of foamable liquid composition from its supply source (e.g., reservoir, refill bottle, refill unit) is illustrated by directional arrows labeled "s", and the direction of recovered foam (which may have been liquefied or partially liquefied under pressurization) is illustrated by directional arrows labeled "rf". As is visible from the state of the foaming pump mechanism 4 illustrated in FIG. 2A, the liquid, air, foam and recovered foam are essentially static at the base of the stroke cycle of cylinders 48, 54 and 95.

FIG. 2B illustrates in a cross-sectional view a second and successive state of the foaming pump mechanism according to a preferred embodiment of the invention. As seen from the figure, the liquid cylinder piston 48 is at the peak of its stroke cycle, coinciding with the minimal volume of the bore 40, the air cylinder piston 54 is also at the peak (top) of its stroke cycle, coinciding with the minimal volume of bore 50 and concurrently the foam recovery piston 97 is at the peak of its stroke cycle, coinciding with the minimal volume of the foam bore 95. As the respective pistons 48, 54 and 97 move from the positions of the first state to the second state as here depicted, the foamable liquid composition present in the bore 40 is pressurized which causes the supply valve 46 to close, and concurrently causes the liquid outlet valve 41 to an open position due to the movement of the valve shaft 43 due to the contact between the proximal end 43A of the valve shaft 43 with the liquid cylinder piston 48 which forces the valve shaft 43 to disengage (lift) the valve 41E from the valve seat 41D which concurrently compresses the biasing spring 41B and which also opens the liquid outlet valve 41 permitting the passage of the foamable liquid composition present in the bore 40 therethrough. The foamable liquid composition is forced through the liquid outlet valve 41 and through the liquid outlet tube 60 and via the liquid inlet port 72 into the dispensing nozzle 70, as indicated by directional arrows "l". Concurrently the air present within the bore 50 of the air cylinder 51 is forced past the air outlet valve 53 which is forced into an open state or open position, and via the air outlet tube 64 into the dispensing nozzle 70 via an air inlet port 74 which port is downstream of the liquid inlet port 72 of the dispensing nozzle 70. The direction of air flow is indicated by directional arrows "a". Also concurrently, the contents of the foam recovery cylinder 93 which may included foamed liquid composition, and/or which may included foamable liquid composition which has lost its foamed characteristic and has reverted to a liquid state are pumped through the foam recycle valve 87 which is in an open position, through foam recycle tube 88 wherein it is returned to the supply source, via a return conduit 46A, which in the preferred embodiment is a part of the supply valve 46. At this stage, while the foam recycle valve 87 is open, the foam check valve 89 is closed. Notwithstanding the depiction it is to be understood that the return conduit 46A may be a separate element from the supply valve 46 if desired. The foamable liquid and air thus injected via their respective inlet ports 72, 74 are mixed within the dispensing nozzle 70 and expelled therefrom, viz., is delivered as a foaming or foamable liquid composition from a delivery outlet 73 of the dispensing nozzle 70 as indicated by directional arrows "f". Further details of the dispensing nozzle 70 are disclosed in further figures.

An advantageous feature of the foregoing arrangement of elements is that during its operation, the foam recovery cylinder 93 may return a quantity of air, or aerated foamable liquid composition via the foam recycle tube 88 back to the fluid supply, which in preferred embodiments may be a refill unit 1 which includes a cap 1C affixed to a container body 1A sealed to the cap. Where the container body 1A is made of a flexible material, e.g., a thin-walled polymeric material such as a thermoplastic polymer, e.g., a polyalkylene terephtalate such as PET, or a polyolefin, e.g., a polyethylene which thermoplastic polymers may be blow molded to form the container body 1A, such a container body 1A may have an undesirable tendency to warp, or collapse if a vacuum is built up within the refill unit 1. The operation of the foregoing arrangement of elements provides for a means whereby a quantity of air may be supplied to the refill unit 1 through the foam recycle tube 88 and the return conduit 46A which can relieve, or eliminate a build up of vacuum within the refill unit 1. Such also reduces or eliminates the likelihood of undesirable "paneling" of a refill unit 1 comprising a container body 1A is made of a flexible material in a sealed relationship with a cap 1C particularly when the refill unit comprises no valves, or vents to the ambient atmosphere which would otherwise relieve the build up of a vacuum within the refill unit 1.

Figure 2C:
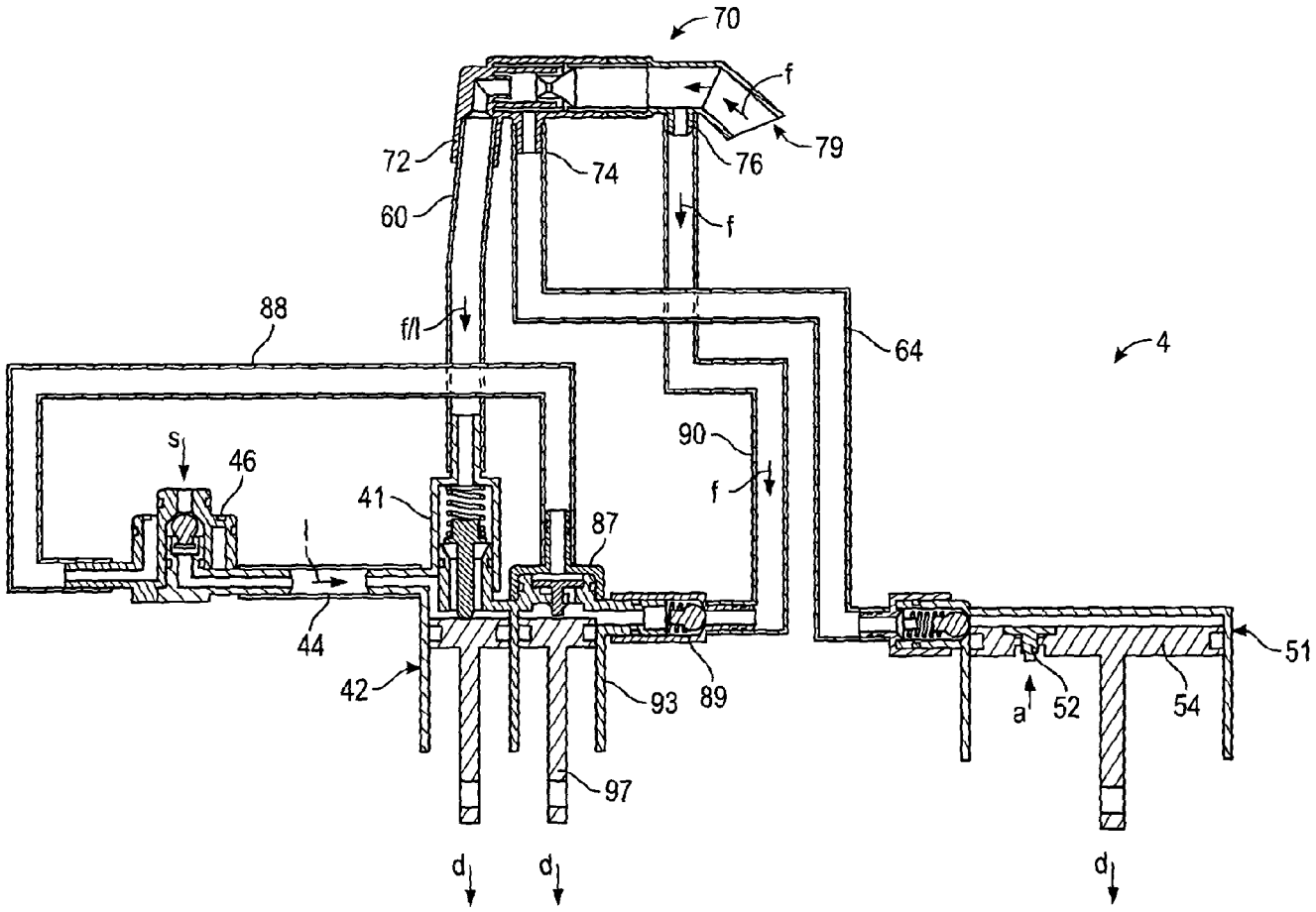

FIG. 2C illustrates in a cross-sectional view a third and successive state of the foaming pump mechanism according to a preferred embodiment of the invention which follows immediately after the second state of the foaming pump mechanism. In this third state, the liquid cylinder piston 48, the air cylinder piston 54 and the foam recovery cylinder 93 have transited just past the peak (top) of their stroke cycles and are returning to the base (bottom) of their stroke cycles. At this third state, the downward movement of the liquid cylinder piston 48 and the air cylinder piston 54 generates a suction within the dispensing nozzle 70 and the liquid outlet tube 60 and via the liquid inlet port 72 due to the operation of the liquid outlet valve 41. Concurrently however, no like suction is present within the air outlet tube 64 as the downward movement of the air cylinder piston 54 causes the air outlet valve 53 to close sealing it from the bore 50 which is resupplied with air via the air supply valve 52 present within the air cylinder piston 54 which is urged into an open position and permits for the passage of ambient air to enter into the bore 50. As the liquid cylinder piston 48 continues its downward transit towards the base of its stroke, the transiting air cylinder piston 54 continually generates a suction within the bore 40 which causes at least partial retraction of the foamable liquid composition and/or foamed liquid composition present within the dispensing nozzle 70, the liquid outlet tube 60 or both, while the contact between the proximal end 43A of the valve shaft 43 with the liquid cylinder piston 48 persists and causes the valve 41E positioned on the valve shaft 43 to remain disengaged (lifted) from the valve seat 41D, thereby permitting reentry of the foamable liquid composition and/or foamed liquid composition into the bore 40 of the liquid cylinder 42. Concurrently, the downwardly transiting foam recovery piston 97 of the foam recovery cylinder 93 causes the partial retraction of foamed liquid composition present within the dispensing nozzle 70 in a foam recovery zone 78 which is downstream of the liquid inlet port 72 and the air inlet port 74, as well as downstream of the mesh 73 but prior to the nozzle outlet 79. Advantageously, the foam recovery zone 78 may be considered to be the interior volume of the nozzle 70 downstream of the mesh 73 and at least to the nozzle outlet 79, and may extend slightly beyond the end of the nozzle outlet 79 should any foamed liquid composition be present depending from the nozzle 70 and in particular the nozzle outlet 79. During the downward transit of the foam recovery piston 97, foam check valve 89 is open, while foam recycle valve 87 is closed, which allows for recovery of foamed treatment composition from the foam recovery zone 78 into at least the foam recovery tube 90, from whence it will ultimately pass via the open foam check valve 89 into the bore 91 of the foam recovery cylinder 93.

Figure 2D:
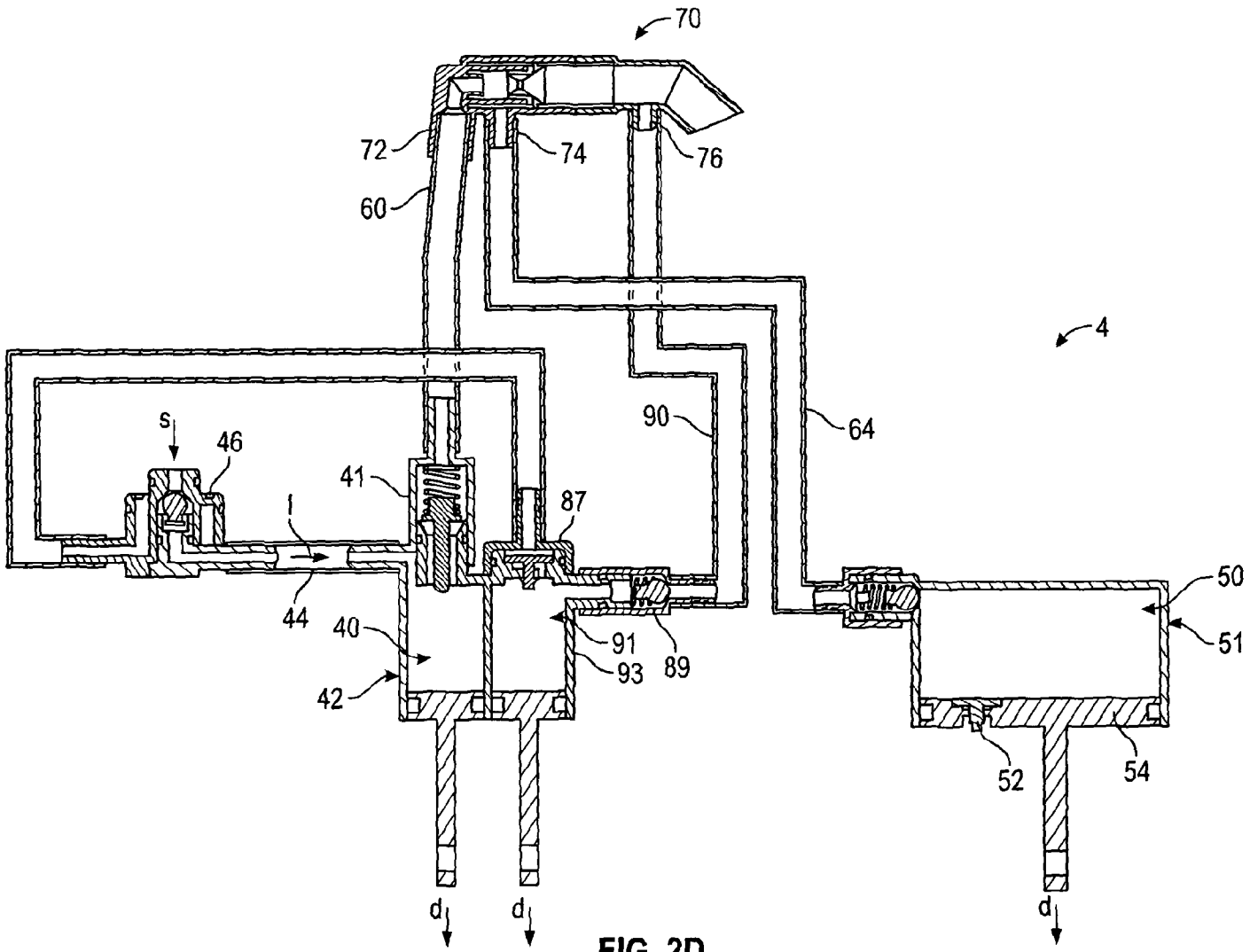

FIG. 2D illustrates in a cross-sectional view a fourth and successive state of the foaming pump mechanism according to a preferred embodiment of the invention which follows immediately after the third state of the foaming pump mechanism. In this fourth state, the liquid cylinder piston 48 and the air cylinder piston 54 have transited approximately midway from the peak (top) of their stroke cycles and are returning to the base (bottom) of their stroke cycles. At this fourth state, the downward movement of the air cylinder piston 54 causes the air outlet valve 53 to close, sealing it from the bore 50 which is resupplied with air via the air supply valve 52 present within the air cylinder piston 54 which is urged into an open position and permits for the passage of ambient air to enter into the bore 50, and thus resupplying it. At this point of its transit, the cylinder piston 48 continues its downward transit towards the base of its stroke, the contact between the proximal end 43A of the valve shaft 43 with the liquid cylinder piston 48 ceases which causes the valve 41E positioned on the valve shaft 43 to engage the valve seat 41D due to the action of the a biasing spring 41B, thereby closing the liquid outlet valve 41 denying passage of the foamable liquid composition therethrough and breaking any suction caused by the liquid cylinder piston 48 and liquid cylinder 42 within the dispensing nozzle 70, the liquid outlet tube 60 or both. Concurrently at this point of its transit, the suction within the liquid cylinder 42 caused by the continued transit of the liquid cylinder piston 48 returning to the base it its stroke cycle increases the flow rate of foamable liquid composition entering into the bore 40 via the supply tube 44 and past the supply valve 46 which is in fluid communication with the supply of the foamable liquid composition. The downward strokes of the liquid cylinder piston 48 within the liquid cylinder 42 and of the air cylinder piston 54 within the air cylinder 51 cause the respective cylinders 42, 52 to be refilled with foamable liquid composition and air until the respective pistons 40, 50 return to the base (bottom) of their stroke cycles, and return to the first state of the foaming pump mechanism described with reference to FIG. 2A. Also concurrently, this point of its transit, the suction within the bore 91 of the foam recovery cylinder 93 was by the continued downward transit of the foam recovery piston 97 causes at least part of the foam recovery cylinder 93 to be refilled with foamed liquid composition and/or air until foam recovery piston 97 returns to its base (bottom) of its stroke cycle, and it returns to the first state of the foaming pump mechanism described with reference to FIG. 2A.

Thereafter, the foaming pump mechanism described operates in the successive stages of operation indicated by respective FIGS. 2A, 2B, 2C and 2D. The foaming pump mechanism may operate continuously, or intermittently. The operation of the foaming pump mechanism may be at any of the respective stages described in FIGS. 2A, 2B, 2C and 2D or may be in any position arrangement of elements intermediate anti-of these respective stages. Advantageously however, the foaming pump mechanism operates to complete a full cycle beginning were in the liquid cylinder piston 48, air cylinder piston 54 and foam recovery piston 97 operate through at least one complete stroke cycle.

Amongst further important features of the foaming pump mechanism is the volumetric delivery rate of the foaming or foamable liquid composition and the air during a stroke cycle of the foaming pump mechanism. Conveniently such may be established by or at least approximated by the differences in the volumes of the liquid cylinder 42 and the air cylinder 51 between the base and peak of the stroke cycles of their respective liquid cylinder piston 48 and air cylinder piston 58. Alternately the volumetric delivery rate of the foaming or foamable liquid composition and the air during a stroke cycle of the foaming pump mechanism can be established by actual quantitative measurement of the foaming or foamable liquid composition and the air during a stroke cycle delivered between the base and peak of a stroke cycle of the respective liquid cylinder piston 48 and air cylinder piston 58. Advantageously the volumetric ratios of the volumes of the liquid cylinder 42 and the air cylinder 51 and foam cylinder 93 between the base and peak of the stroke cycles is between about 1:8-12:0.8-1.2, preferably is between about 1:9-11:0.9-1.1, and especially preferably is about 1:10:1. Alternately the ratios of the volumetric delivery rate of the foaming or foamable liquid composition and the air during a stroke cycle of the foaming pump mechanism is between about 1:9-11, preferably is about 1:9.5-10.5, and especially preferably is about 1:10. It is to be understood that the foregoing ratios are provided by way of illustration and not by way of limitation, as a skilled artisan will readily comprehend that the constituents used to form a foaming or foamable liquid composition may vary widely, and the degree of foaming of the said liquid composition may also vary widely as it is delivered from the foaming pump mechanisms described herein. Thus a wide degree of latitude in the specification of the said volumetric ratios, or the said ratios of the volumetric delivery rate are permitted as being in no small part due to the composition of the foaming or foamable liquid composition to be dispensed and delivered as a foamed product from the foaming pump mechanisms described herein.

Figure 3A:
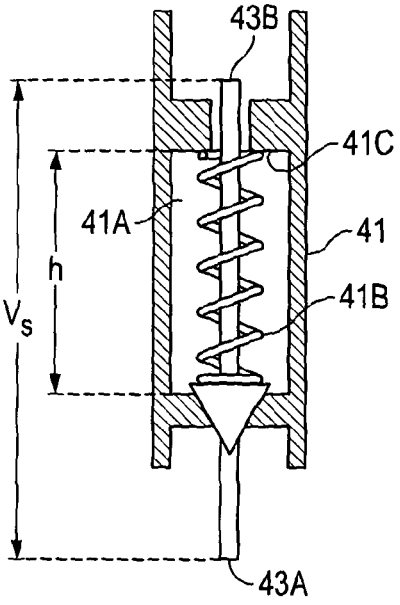
FIGS. 3A and 3B illustrate in cross-sectional views the liquid outlet valve in two different states of operation.
Figure 3B:
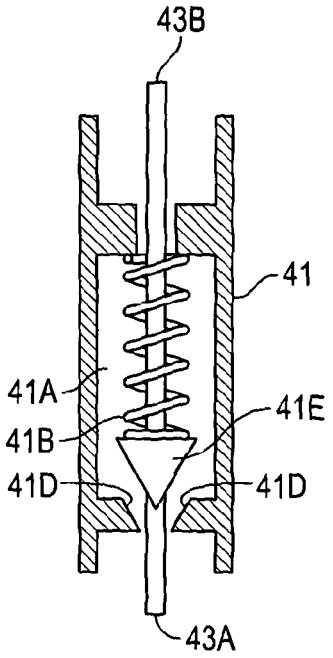

FIGS. 3A and 3B illustrate in cross-sectional views the liquid outlet valve in two different states of operation. The liquid outlet valve 41 comprises a valve bore 41A, a biasing spring 41B, a bore shoulder 41C, a circular valve seat 41D and a circular valve 41E mounted transversely upon a valve shaft 43. The circular valve seat 41D and the valve 41E are abuttable to form a liquid tight seal therebetween when the circular valve 41E is seated upon or within the circular valve seat 41D. Of course different configurations of valves and valve seats other than disclosed herein in FIGS. 3A and 3B may be used, as long as such fulfill a similar function as the depicted elements. The valve shaft 43 is being longer having a dimension "vs" which is greater than the height having a dimension "h" of the valve bore 41A as measured between the bore shoulder 41C and the valve seat 41D, and preferably as shown, the valve shaft 43 has a proximal end 43A extending at least to but preferably past the valve seat 41D and into the bore 40, and a distal end 43B extending at least to, but preferably past the bore shoulder 41C. The biasing spring 41B extends within the valve bore 41A about a part of the valve shaft 43 and extends between the bore shoulder 41C and the valve 41E biasing the valve 41E into the valve seat 41D when the proximal end 43A is not in contact with the liquid cylinder piston 48. In the position or state shown in FIG. 3A, the valve 41E is engaged against the valve seat 41D which closes the liquid outlet valve 41 denying passage of the foamable liquid composition therethrough. In the position or state shown in FIG. 3A, the valve 41E is disengaged from the valve seat 41D which opens closes the liquid outlet valve 41 permitting passage of the foamable liquid composition therethrough.

Figure 3C:
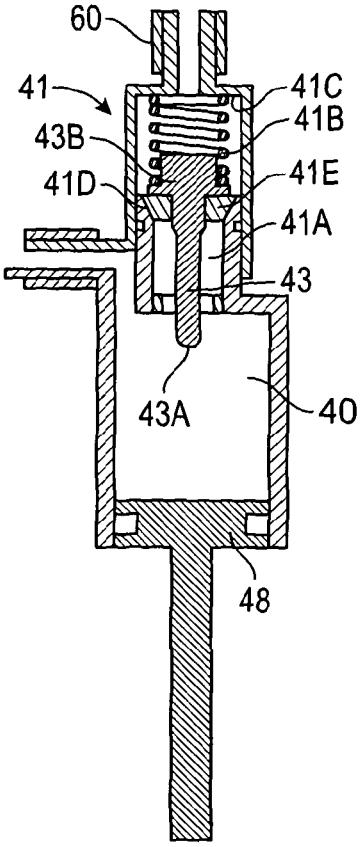
FIGS. 3C and 3D illustrate in cross-sectional views a further embodiment of a liquid outlet valve in two different states of operation.
Figure 3D:
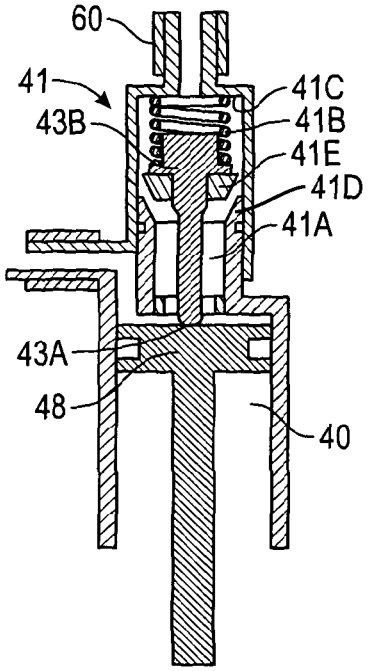

FIGS. 3C and 3D illustrate in cross-sectional views of an alternate and a preferred embodiment of the liquid outlet valve in two different states of operation, which operates in a manner similar to the liquid outlet valve 41 of FIGS. 3A and 3B. The embodiment of FIGS. 3C and 3D correspond to the embodiment of the liquid outlet valve 41 illustrated in FIGS. 2A-2D. Herein the liquid outlet valve 41 comprises a valve bore 41A, a biasing spring 41B, a bore shoulder 41C, a valve seat 41D and a frustoconical valve 41E mounted transversely upon a valve shaft 43. The valve seat 41D and the frustoconical valve 41E are abuttable to form a liquid tight seal therebetween when the circular valve 41E is seated upon or within the circular valve seat 41D, as illustrated in FIG. 3C. The valve shaft 43 has a proximal end 43A extending at least to but preferably past the valve seat 41D and into the bore 40, and a distal end 43B extending in abutment with the biasing spring 41B. The biasing spring 41B extends within the valve bore 41A about a part of the distal end 43B and extends between it and the bore shoulder 41C biasing the frustoconical valve 41E into the valve seat 41D when the proximal end 43A is not in contact with the liquid cylinder piston 48. In the position or state shown in FIG. 3C which corresponds to the state of the liquid outlet valve depicted in FIG. 2A, the frustoconical valve 41E is engaged against the valve seat 41D which closes the liquid outlet valve 41 denying passage of the foamable liquid composition therethrough. In the position or state shown in FIG. 3D which corresponds to the state of the liquid outlet valve depicted in FIG. 2B, the valve 41E is disengaged from the valve seat 41D which opens the liquid outlet valve 41 permitting passage of the foamable liquid composition therethrough from the bore 40 and the liquid outlet tube 60.

Figure 4:
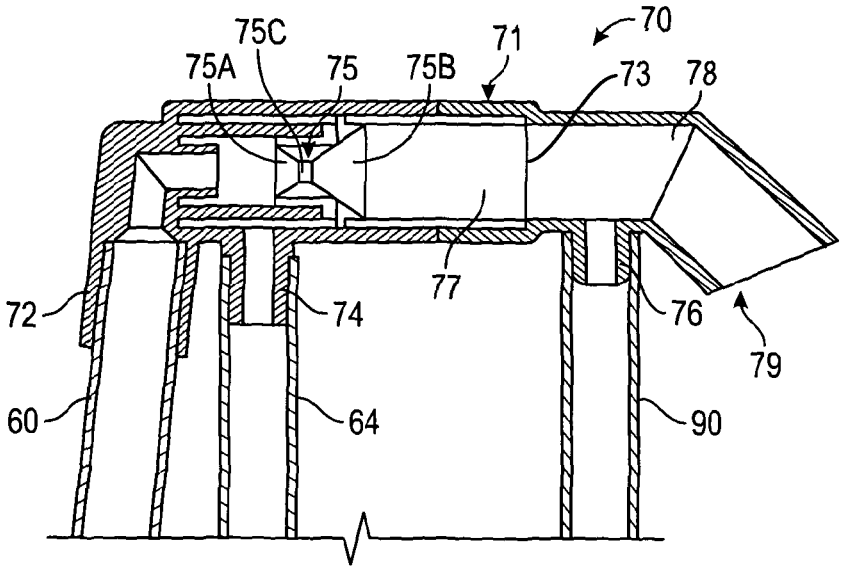
FIG. 4 depicts in cross-sectional view details of the interior of a preferred embodiment of a dispensing nozzle.

FIG. 4 illustrates in a cross-sectional view a dispensing nozzle 70 having a generally tubular body 71 which extends from a liquid inlet port 72 and an air inlet port 74, to a nozzle outlet 79. Intermediate and traversing the body 71 is a screen 73 having a plurality of perforations passing therethrough of a relatively small size. The position of the screen 73 across the flow path of both foamable liquid composition and air and cream via their respective liquid inlet port 72 and air inlet port 74 to the screen 73 defines a mixing zone 77 (or mixing chamber) within the nozzle 70. Advantageously, the foamable liquid composition and air are required to pass through a constriction element 75 here illustrated is an element having a generally conical inlet section 75A which tapers inwardly to a constricted passage 75C having a smaller diameter or area then the inlet of the conical inlet section 75A, and downstream thereof a generally conical outlet section 75B which tapers outwardly and outlet, which has a larger diameter or area than that of the constricted passage 75C. Foamable liquid composition and air passing through the constriction element 75 are compressed, mixed, and then decompressed as they exit the constricted passage 75C and enter the mixing zone 77 and thereafter pass through the screen 73. The now foamed liquid composition passes into the foam recovery zone 78 and thereafter exits the nozzle 70 of the nozzle outlet 79. As is seen thereon, a foam recovery port 76 is also present within the foam recovery zone 78 and is in fluid connection with the foam recovery tube 90 through which any foamed liquid composition may be withdrawn from the foam recovery zone 78.

Advantageously the screen 73 includes a plurality of perforations passing therethrough of a relatively small size. The perforations may be of any closed, regular or irregular geometric shape., e.g. polygons such as squares, rectangles, pentagons, heaxagons, circles or ellipses, or may be irregularly shaped. The perforations have a maximum dimension to the openings which they provide through the screen 73, e.g., in the case of a circle, the opening would be the diameter and in the case of a square or rectangular perforation, the opening would be the distance between two non-adjacent corners. The maximum dimension of the openings, also referred to as a "maximum opening dimension", for other perforations and shapes can be routinely determined using conventional geometric methods, or more simply, by measuring. Preferably the maximum dimension of the openings of the individual perforations, is preferably in the range of from about 1 micron to about 500 microns, but preferably are in the range of about 10-200 microns, yet more preferably are in the range of between about 20-75 microns. In the embodiments illustrated in the figures, the screen 73 comprises a plurality of regularly spaced apart square perforations measuring 30 microns by 30 microns, which establishes a maximum opening dimension of 42.4 microns. It is of course to be understood that the selection of an optimal cross-sectional dimension or radius for these perforations may be influenced by other operating characteristics of the foaming pump mechanism, as well as the constituents used to form the foamable or foaming liquid composition being used with the foaming pump mechanism.

Use of the preferred foaming pump mechanism as described provides a reliable mechanism for the delivery of controlled doses of a foaming or foamable liquid composition which is particularly useful when incorporated into a device for delivery of such a product. It is considered that the foaming pump mechanism may be used with both manually operated dispensing devices wherein a user provides the motive force for the operation of the foaming pump mechanism, as well as in powered devices wherein a motor or engine is utilized to drive the foaming pump mechanism. Particularly advantageously the foaming pump mechanism is used as part of a "hands-free" type of dispenser which does not require direct physical contact between a user or consumer, but which device automatically dispenses a metered amount of the foaming or foamable liquid composition in response to an input signal which may be a non-contact input signal. Examples of non-contact input signal includes one or more of: sound, light, and proximity.

The refill unit 1 may include a container body 1A, e.g., a bottle or flask, which may be a generally rigid plastics container, for example, containing liquid soap, a topical treatment composition, or other liquid composition. As can be understood from the figures, according to the preferred embodiment shown in the figures, the container body 1A is generally elliptical in cross-section.

The foaming pump mechanism described herein, as well as dispensing devices which incorporate a foaming pump mechanism as taught herein may be used to deliver a wide variety of foamable or foaming liquid compositions in a reliable manner. It may also be used to dispense other liquid or semi-liquid products (ideally with a viscosity greater than water), for use in personal care, e.g., topically applied compositions such as hand cream, body lotion, moisturizer, face cream, acne treatment compositions, shampoo, shower gel, foaming hand wash, shaving cream, washing-up liquid, toothpaste, a sanitizing composition agent such as alcohol gel or other topically applied sanitizing composition. The bottle may also be used to dispense other surface treatment compositions, (e.g., hard surface, soft surface) either directly to a locus to be treated, but preferentially onto a carrier material or substrate, such as a person's hand, a sponge, a brush, a wipe article, a disposable wipe article (napkin, tissue, paper towel, etc.) and the like. By way of non-limiting example such surface treatment compositions include those for the treatment of inanimate or non-porous hard surfaces, such as can be encountered in a kitchen or bath, dishware, tableware, pots, pans, textiles including garments, textiles, carpets, and the like. In the preferred embodiment shown, the refill unit 1 is specifically designed to be used in an inverted configuration on an automatic dispenser, as depicted in FIG. 1, but such is to be understood as a non-limiting illustration of one aspect of the invention.

The invention claimed is:

1. A foaming pump mechanism for dispensing a foamable or foaming liquid composition comprising:

a liquid cylinder in fluid communication with a supply of a foaming or foamable liquid composition and in fluid communication with a dispensing nozzle, the liquid cylinder further including a bore and a liquid cylinder piston moveable with the bore;

an air cylinder in fluid communication with the dispensing nozzle, the air cylinder further including a bore and an air cylinder piston moveable within the bore; and a foam recovery cylinder in fluid communication with the dispensing nozzle, the foam recovery cylinder further including a bore and a foam recovery piston within the bore;

wherein the dispensing nozzle having a body which includes an a liquid inlet port in fluid communication with the liquid cylinder, an air inlet port in fluid communication with the air cylinder, at least one screen within the body of the dispensing nozzle, and downstream of the at least one screen a foam recovery port within a foam recovery zone prior to a nozzle outlet.

2. The foaming pump mechanism according to claim 1, wherein:

the volumetric ratios of the volumes of the liquid cylinder, the air cylinder and the foam recovery cylinder between the base and peak of their respective stroke cycles is between 1:8-12:0.8-1.2.

3. The foaming pump mechanism according to claim 1, wherein:

the volumetric ratios of the volumes of the liquid cylinder, the air cylinder and the foam recovery cylinder between the base and peak of their respective stroke cycles is between 1:9-11:0.9-1.1.

4. The foaming pump mechanism according to claim 1, wherein:

the volumetric ratios of the volumes of the liquid cylinder, the air cylinder and the foam recovery cylinder between the base and peak of their respective stroke cycles is about 1:10:1.

5. The foaming pump mechanism according to claim 1, wherein:

downstream of the bore of the liquid cylinder is present a liquid outlet valve which comprises: a valve bore, a biasing spring, a bore shoulder, a valve seat and a valve mounted on a valve shaft said valve shaft extending into the bore.

6. The foaming pump mechanism according to claim 1, wherein:

the dispensing nozzle includes only a single screen.

7. A dispenser for providing a foamable or foaming liquid composition to a user comprising:

a reservoir which forms part of the dispenser, and a foaming pump mechanism according to claim 1.

8. The dispenser according to claim 7, wherein the reservoir is a refill unit insertable into a base of the dispenser.

9. The dispenser according to claim 7, wherein the foaming pump mechanism is driven by a motor.

10. The dispenser according to claim 7, wherein the dispenser initiates dispensing by a non-contact interaction with the user.

11. A foaming pump mechanism for dispensing a foamable or foaming liquid composition comprising:

a liquid cylinder in fluid communication with a supply of a foaming or foamable liquid composition and in fluid communication with a dispensing nozzle, the liquid cylinder further including a bore and a liquid cylinder piston moveable with the bore;

an air cylinder in fluid communication with the dispensing nozzle, the air cylinder further including a bore and an air cylinder piston moveable within the bore; and a foam recovery cylinder in fluid communication with the dispensing nozzle, the foam recovery cylinder further including a bore and a foam recovery piston within the bore;

wherein the dispensing nozzle having a body which includes an a liquid inlet port in fluid communication with the liquid cylinder, an air inlet port in fluid communication with the air cylinder, at least one screen within the body of the dispensing nozzle, and downstream of the at least one screen a foam recovery port within a foam recovery zone prior to a nozzle outlet; and wherein the volumetric ratios of the volumes of the liquid cylinder, the air cylinder and the foam recovery cylinder between the base and peak of their respective stroke cycles is between 1:8-12:0.8-1.2.

12. The foaming pump mechanism according to claim 11, wherein downstream of the bore of the liquid cylinder is present a liquid outlet valve comprising:

a valve bore;

a biasing spring;

a bore shoulder;

a valve seat; and a valve mounted on a valve shaft;

wherein the valve shaft extends into the bore.

13. The foaming pump mechanism according to claim 11, wherein the dispensing nozzle includes only a single screen.

14. A dispenser for providing a foamable or foaming liquid composition to a user comprising:

a reservoir which forms part of the dispenser, and a foaming pump mechanism according to claim 11.

15. The dispenser according to claim 14, wherein the reservoir is a refill unit insertable into a base of the dispenser.

16. The dispenser according to claim 14, wherein the foaming pump mechanism is driven by a motor.

17. The dispenser according to claim 14, wherein the dispenser initiates dispensing by a non-contact interaction with the user.

* * * * *